US008082745B2

(12) United States Patent
Sawada et al.

(10) Patent No.: US 8,082,745 B2
(45) Date of Patent: Dec. 27, 2011

(54) REFRIGERATION CYCLE SYSTEM

(75) Inventors: Yoshikatsu Sawada, Kariya (JP); Yasutane Hijikata, Nagoya (JP)

(73) Assignee: Denso Corporation, Kariya (JP)

( * ) Notice: Subject to any disclaimer, the term of this patent is extended or adjusted under 35 U.S.C. 154(b) by 498 days.

(21) Appl. No.: 12/153,711

(22) Filed: May 22, 2008

(65) Prior Publication Data

US 2008/0289348 A1 Nov. 27, 2008

(30) Foreign Application Priority Data

May 24, 2007 (JP) ..... 2007-137478

(51) Int. Cl.
*F25B 31/00* (2006.01)
*F25B 43/02* (2006.01)

(52) U.S. Cl. ..... 62/193; 62/468; 62/470; 73/861.52; 73/861.61

(58) Field of Classification Search ..... 62/84, 192, 62/193, 468, 469, 470; 73/861.42, 861.45, 73/861.52, 861.61
See application file for complete search history.

(56) References Cited

U.S. PATENT DOCUMENTS

| | | | | |
|---|---|---|---|---|
| 4,653,288 | A * | 3/1987 | Sayo et al. | 62/210 |
| 5,884,494 | A * | 3/1999 | Okoren et al. | 62/126 |
| 2002/0035841 | A1 * | 3/2002 | Flynn | 62/217 |

FOREIGN PATENT DOCUMENTS

| | | | |
|---|---|---|---|
| JP | 01262216 | A * | 10/1989 |
| JP | A-06-281300 | | 10/1994 |
| JP | A-2000-321103 | | 11/2000 |
| JP | A-2005-055167 | | 3/2005 |
| JP | A-2005-180808 | | 7/2005 |

OTHER PUBLICATIONS

Office Action mailed Mar. 3, 2009 in corresponding Japanese patent application No. 2007-137478 (and English translation).
Office Action mailed Sep. 1, 2009 in corresponding Japanese patent application No. 2007-137478 (English translation enclosed).

* cited by examiner

*Primary Examiner* — Marc Norman
(74) *Attorney, Agent, or Firm* — Posz Law Group, PLC

(57) ABSTRACT

A refrigeration cycle system is disclosed. A compression unit 11 for compressing the refrigerant by the drive force of a vehicle engine 4 is arranged in a housing 10 of a compressor 1. The flow rate of the refrigerant discharged from the compression unit 11 is detected by a flow rate sensor 15 including a throttle portion 15*b* and a pressure difference detection mechanism 15*a*. The throttle portion 15*b* reduces the flow rate of the refrigerant discharged from the compression unit 11. The pressure difference detection mechanism 15*a* detects the pressure difference between the upstream side and the downstream side of the throttle portion 15*b* in the refrigerant flow thereby to detect the flow rate of the refrigerant discharged from the compression unit 11. An oil separator 12 for separating the lubricating oil from the refrigerant discharged from the compression unit 11 is interposed between the compression unit 11 and the flow rate sensor 15.

5 Claims, 2 Drawing Sheets

REFRIGERATION CYCLE SYSTEM

BACKGROUND OF THE INVENTION

1. Field of the Invention

This invention relates to a refrigeration cycle system.

2. Description of the Related Art

A conventional air conditioning system for automotive vehicles includes a compressor driven by an automotive engine for compressing a refrigerant, a cooler for cooling the refrigerant discharged from the compressor, a decompressor for reducing the pressure of the refrigerant cooled by the cooler and an evaporator for evaporating the refrigerant on the downstream side of the decompressor (see, for example, Japanese Unexamined Patent Publication No. 2005-55167).

SUMMARY OF THE INVENTION

The present inventor has studied the arrangement of a flow rate sensor for detecting the flow rate of the gas-phase refrigerant discharged from the compressor of the automotive air conditioning system and has found that the problem described below occurs.

Specifically, a gas-phase refrigerant discharged from a compressor contains a lubricating oil, and therefore the refrigerant flow rate cannot be accurately determined by detecting the flow rate of the gas-phase refrigerant discharged from the compressor as it is.

In view of the point described above, the object of this invention is to provide a refrigeration cycle system capable of detecting the refrigerant flow rate more accurately.

In order to achieve this object, according to this invention, there is provided a refrigeration cycle system having a compressor for sucking, compressing and discharging a refrigerant, comprising:

a flow rate sensor (15) for detecting the flow rate of the refrigerant discharged from the compressor;

an oil separator (12) arranged on the upstream side of the flow rate sensor in the refrigerant flow to separate the lubricating oil from the refrigerant discharged from the compressor; and an oil introduction path (14) for introducing the lubricating oil separated by the oil separator to the refrigerant inlet of the compressor.

The refrigerant from which the lubricating oil is removed by the oil separator flows into the flow rate sensor, and therefore the refrigerant flow rate can be detected more accurately by the flow rate sensor.

Incidentally, the reference numerals inserted in the parentheses following the names of the respective means included in the claims and described in this section indicate the correspondence with the specific means described below in the embodiments.

The present invention may be more fully understood from the description of preferred embodiments of the invention, as set forth below, together with the accompanying drawings.

DESCRIPTION OF THE PREFERRED EMBODIMENTS

Figure 1:
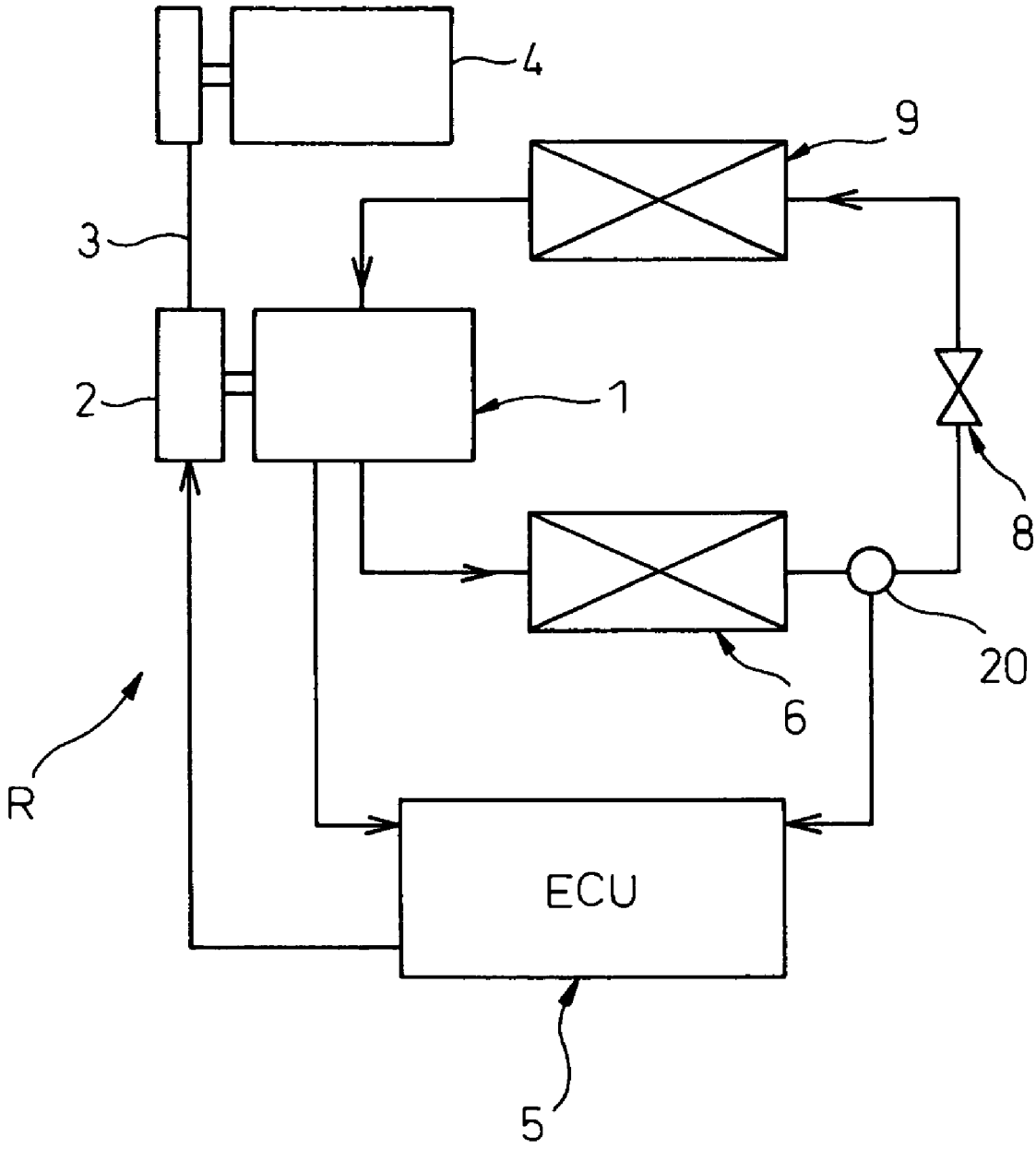
FIG. 1 is a schematic diagram showing the configuration of an automotive refrigeration cycle system R according to an embodiment of the invention.

FIG. 1 is a schematic diagram showing the configuration of an automotive refrigeration cycle system R according to an embodiment of the invention.

Automotive refrigeration cycle system R according to this embodiment includes a compressor 1 for sucking, compressing and discharging refrigerant. Compressor 1 includes an electromagnetic clutch 2 for turning on/off the power. The drive force of a vehicle engine 4 is transmitted to compressor 1 through electromagnetic clutch 2 and a belt 3. Power supplied to electromagnetic clutch 2 is turned on/off by an electronic control unit 5 thereby to turn on/off the operation of compressor 1.

The high-temperature, high-pressure gas refrigerant discharged from compressor 1 flows into a condenser as a cooler, in which heat is exchanged with the atmospheric air blown in from a cooling fan not shown thereby to cool and condense the refrigerant. The refrigerant condensed by condenser 6 is reduced to low pressure by an expansion valve 8 as a decompressor. The low-pressure refrigerant from expansion valve 8 flows into an evaporator (cooling heat exchanger) 9.

Evaporator 9 is arranged in an air-conditioning case (not shown) of the automotive air conditioning system for regulating the air temperature in a passenger compartment. In the air-conditioning case, a blower is arranged on the upstream side of evaporator 9. The air from the blower is blown to evaporator 9. As a result, the low-pressure refrigerant that has flowed into evaporator 9 is evaporated by absorbing heat from the air in the air-conditioning case. The outlet of evaporator 9 is coupled to the intake side of compressor 1 and thus a closed circuit is formed.

Figure 2:
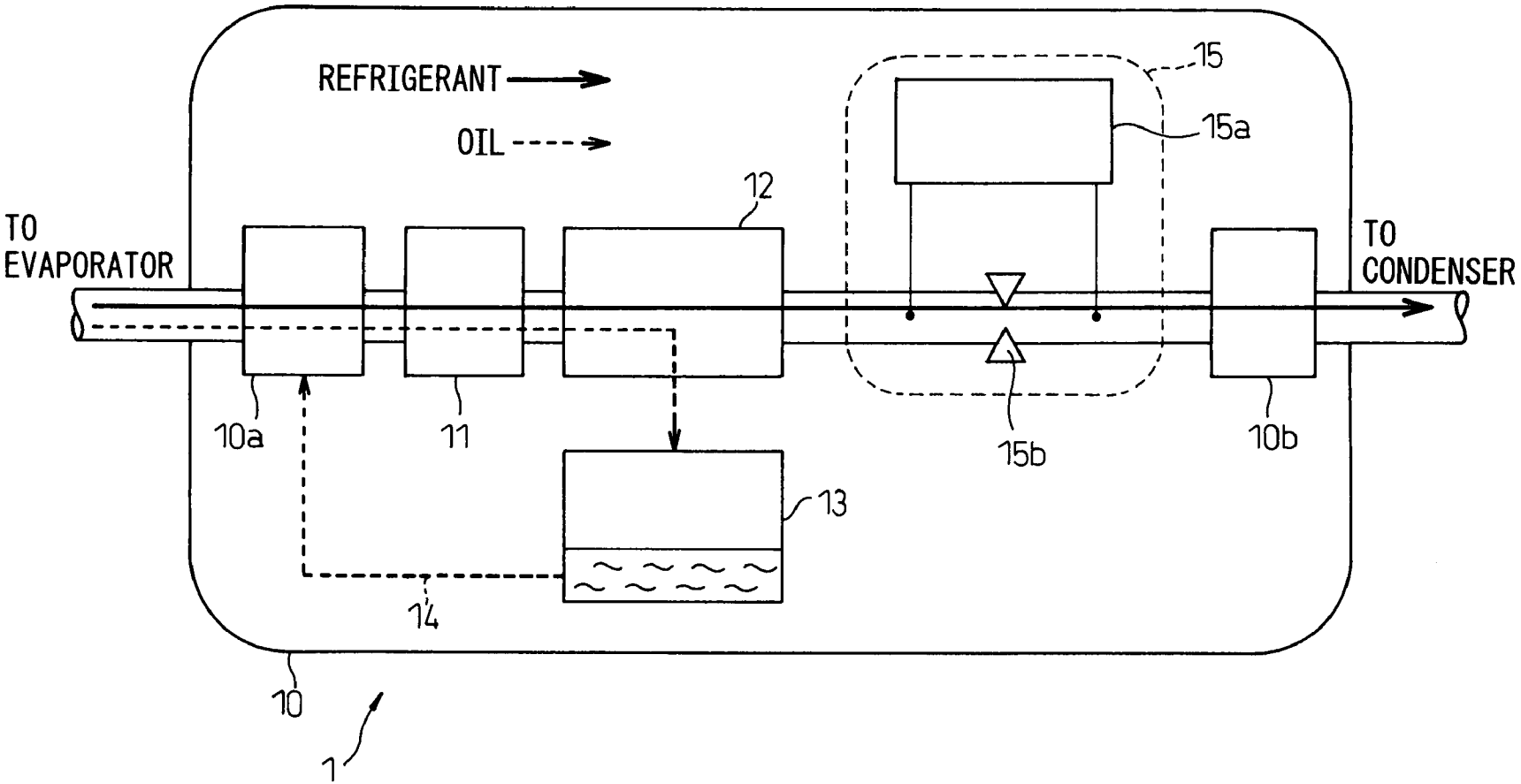
FIG. 2 is a diagram showing the structure of the compressor shown in FIG. 1.

Next, the constitution of compressor 1 according to this embodiment will be explained. FIG. 2 shows the constitution of compressor 1.

Compressor 1 includes a housing 10 having a refrigerant inlet 10*a* and a refrigerant outlet 10*b*. A compression unit 11, in which the refrigerant introduced therein through refrigerant inlet 10*a* by the drive force of a vehicle engine 4 is compressed and discharged from refrigerant outlet 10*b*, is arranged in housing 10.

A flow rate sensor 15 for detecting the flow rate of the refrigerant discharged from compression unit 11 is also arranged in housing 10. Specifically, flow rate sensor 15 is arranged inside compressor 1. An oil separator 12 for separating the lubricating oil from the refrigerant discharged from compression unit 11 is interposed between compression unit 11 and flow rate sensor 15.

An oil tank 13 for storing the lubricating oil separated by oil separator 12 is arranged on the downstream side of oil separator 12. The lubricating oil in oil tank 13 is led toward refrigerant inlet 10*a* through an oil introduction path 14. Oil tank 13 and oil introduction path 14 are arranged in housing 10.

As a result, the lubricating oil separated by oil separator 12 can be returned to compression unit 11. Thus, the lubricating oil can be circulated and supplied into compression unit 11, thereby making it possible to lubricate the sliding portions in compression unit 11.

On the other hand, the refrigerant from which the lubricating oil has been removed by oil separator 12 flows into flow rate sensor 15.

Flow rate sensor 15 includes a throttle portion 15*b* and a pressure difference detection mechanism 15*a*. Diaphragm unit 15*b* reduces the flow rate of the refrigerant discharged from compression unit 11. Pressure difference detection mechanism 15*a* detects the refrigerant pressure difference between the upstream side and the downstream side of throttle portion 15*b* in the refrigerant flow.

Electronic control unit 5 calculates the refrigerant flow rate based on the refrigerant pressure difference and the density of the discharged refrigerant (according to Bernoulli's law).

The high pressure and the temperature of the refrigerant are originally required to determine the density of the discharged refrigerant. However, in a certain high pressure range, the pressure and the density of the discharged refrigerant have a one-to-one relation, and therefore the density of the discharged refrigerant can be specified only with the high pressure. Specifically, the refrigerant pressure difference, the high pressure and the flow rate of the discharged refrigerant hold a one-to-one-to-one relation. Therefore, this embodiment includes a high-pressure sensor 20 for detecting the high pressure. Electronic control unit 5 includes a memory for storing a map indicating the relation between the output (refrigerant pressure difference) of flow rate sensor 15, the output (high pressure) of high-pressure sensor 20 and the flow rate of the discharged refrigerant.

Electronic control unit 5 determines the flow rate of the discharged refrigerant based on the map stored in the memory, the output of flow rate sensor 15 and the output of high-pressure sensor 20. This flow rate of the discharged refrigerant is used for calculating the drive torque required to drive compressor 1.

High-pressure sensor 20 is arranged between the refrigerant outlet of condenser 6 and the refrigerant inlet of expansion valve 8 to detect the refrigerant pressure between the refrigerant outlet of condenser 6 and the refrigerant inlet of expansion valve 8. High-pressure sensor 20 is not necessarily arranged between the refrigerant outlet of condenser 6 and the refrigerant inlet of expansion valve 8 but at any place between the refrigerant outlet of compressor 1 and the refrigerant inlet of expansion valve 8.

According to the embodiment described above, oil separator 12 is interposed between compression unit 11 and flow rate sensor 15, and therefore only the refrigerant from which the lubricating oil is removed by oil separator 12 flows into flow rate sensor 15. Thus, the refrigerant amount can be accurately detected by flow rate sensor 15.

Other Embodiments

The embodiment described above represents a case in which flow rate sensor 15 is arranged inside compressor 1. Nevertheless, the invention is not limited to this configuration, and flow sensor 15 may be arranged outside of compressor 1.

Although the embodiments described above concern an example of an application in which the compressor according to this invention is used with the air conditioning system for automotive vehicles, the compressor according to this invention is applicable to a floor-type air-conditioning system such as a gas heat pump air-conditioner driven by an engine.

While the invention has been described by reference to specific embodiments chosen for purposes of illustration, it should be apparent that numerous modifications could be made thereto by those skilled in the art without departing from the basic concept and scope of the invention.

What is claimed is:

1. A refrigeration cycle system having a compressor for sucking, compressing and discharging refrigerant, comprising:

a flow rate sensor for detecting the flow rate of the refrigerant discharged from the compressor;

an oil separator arranged on the upstream side of the flow rate sensor in the refrigerant flow to separate the lubricating oil from the refrigerant discharged from the compressor; and an oil introduction path for introducing the lubricating oil separated by the oil separator to the refrigerant inlet of the compressor, wherein the flow rate sensor includes a throttle portion for reducing the flow rate of the refrigerant discharged from the compressor, and a pressure difference detection mechanism for detecting the refrigerant pressure difference between the upstream side and the downstream side of the throttle portion in the refrigerant flow, wherein the compressor includes a housing having a refrigerant inlet and a refrigerant outlet and a compression unit accommodated in the housing to compress the refrigerant introduced thereinto through the refrigerant inlet and discharge the compressed refrigerant from the refrigerant outlet, and wherein the flow rate sensor is arranged between the compression unit and the refrigerant outlet in the housing.

2. An automotive air conditioning system having the refrigeration cycle system as set forth in claim 1, wherein the compressor is driven by the engine mounted on the automotive vehicle.

3. The refrigeration cycle system according to claim 1 further comprising:

a cooler for cooling the refrigerant discharged from the compressor;

a decompressor for reducing the pressure of the refrigerant cooled by the cooler; and an evaporator for evaporating the refrigerant decompressed by the decompressor, wherein the throttle portion is arranged between the downstream side of the compressor and the upstream side of the decompressor.

4. The refrigeration cycle system according to claim 3, wherein the throttle portion is arranged between the downstream side of the cooler and the upstream side of the decompressor.

5. A refrigeration cycle system having a compressor for sucking, compressing and discharging refrigerant, comprising:

a flow rate sensor for detecting the flow rate of the refrigerant discharged from the compressor;

an oil separator arranged on the upstream side of the flow rate sensor in the refrigerant flow to separate the lubricating oil from the refrigerant discharged from the compressor; and an oil introduction path for introducing the lubricating oil separated by the oil separator to the refrigerant inlet of the compressor, wherein the compressor includes a housing having a refrigerant inlet and a refrigerant outlet and a compression unit accommodated in the housing to compress the refrigerant introduced thereinto through the refrigerant inlet and discharge the compressed refrigerant from the refrigerant outlet, and wherein the flow rate sensor is arranged between the compression unit and the refrigerant outlet in the housing.

* * * * *